US005399391A

United States Patent [19]

Perez-Viera et al.

[11] Patent Number: 5,399,391

[45] Date of Patent: Mar. 21, 1995

[54] INSTANT CHRISTMAS DRESS-UP

[76] Inventors: Margarita Perez-Viera, P.O. Box 747, Fairview, N.J. 07022; George Spector, 233 Broadway Rm 702, New York, N.Y. 10279

[21] Appl. No.: 109,439

[22] Filed: Aug. 20, 1993

[51] Int. Cl.[6] ..... A47G 33/08

[52] U.S. Cl. ..... 428/11; 428/100; 428/101

[58] Field of Search ..... 428/11, 100, 101

[56] References Cited

U.S. PATENT DOCUMENTS

| | | | |
|---|---|---|---|
| 1,666,099 | 4/1928 | Kingman | 428/11 |
| 3,295,577 | 1/1967 | Danielson | 428/100 X |
| 3,829,348 | 8/1974 | Spiegel et al. | 428/11 |
| 4,669,128 | 6/1987 | Furgang | 428/101 X |
| 4,883,441 | 11/1989 | Byer | 428/11 X |

*Primary Examiner*—Henry F. Epstein

[57] ABSTRACT

A decoration is provided for a ball shaped ornament which consists of a decorative band made of a pliable material and a structure for attaching two ends of the decorative band together over the outer surface of the ball shaped ornament, so as to change the appearance of the ball shaped ornament.

2 Claims, 1 Drawing Sheet

INSTANT CHRISTMAS DRESS-UP

BACKGROUND OF THE INVENTION

The instant invention relates generally to seasonal ornaments and more specifically it relates to a decoration for a ball shaped ornament, which provides a decorative band to change the appearance of the ball shaped ornament.

There are available various conventional seasonal ornaments which do not provide the novel improvements of the invention herein disclosed.

SUMMARY OF THE INVENTION

A primary object of the present invention is to provide a decoration for a ball shaped ornament that will overcome the shortcomings of the prior art devices.

Another object is to provide a decoration for a ball shaped ornament that contains a decorative band, which can be made of different colors, materials and patterns, so as to change the appearance of the ball shaped ornament.

An additional object is to provide a decoration for a ball shaped ornament, in which the decorative band makes the ball shaped ornament more versatile, since it is removable and can be used again and again instead of being discarded after a few uses.

A further object is to provide a decoration for a ball shaped ornament that is simple and easy to use.

A still further object is to provide a decoration for a ball shaped ornament that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
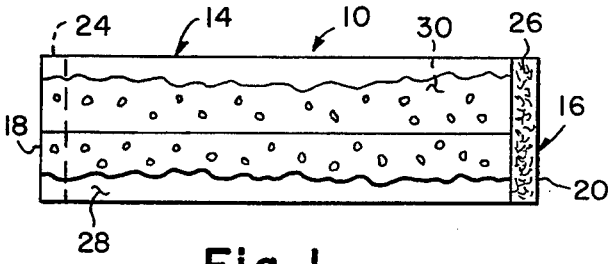
FIG. 1 is a flat open plan view of the instant invention.
Figure 2:
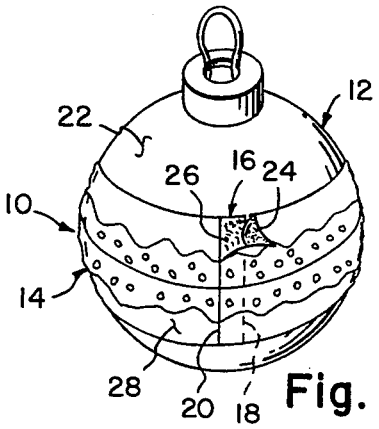
FIG. 2 is a perspective view of a ball shaped ornament with the invention placed thereon.
Figure 3:
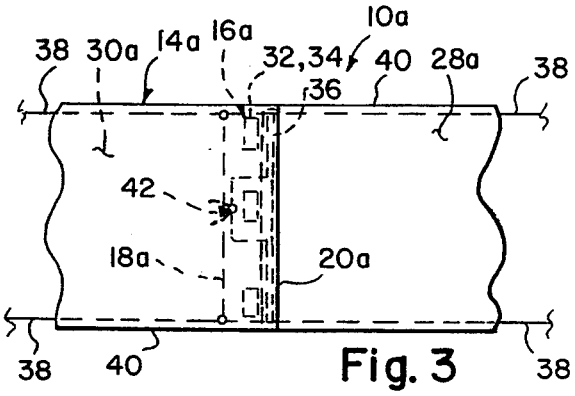
FIG. 3 is an elevational view of a portion of a modification in a closed position, in which a pull string and a stiffener is utilized in drawing the edges of the decorative band about the ball shaped ornament.

Turning now descriptively to the drawings, in which similar reference characters denote similar elements throughout the several views, the FIGS. 1, 2 and 3 illustrate a decoration 10 for a ball shaped ornament 12, which consists of a decorative band 14 made of a pliable material. A structure 16 is for attaching two ends 18 and 20 of the decorative band 14 together over the outer surface 22 of the ball shaped ornament 12, so as to change the appearance of the ball shaped ornament 12. The decorative band 14 can be made of different colors, materials and patterns, so as to make the appearance of the ball shaped ornament 12 more versatile.

The attaching structure 16 includes two strips 24 and 26 of mating hook and loop pile fastener material, in which the strips 24 and 26 are affixed to opposite surfaces 28 and 30 of the decorative band 14, at the two ends 18 and 20. When the decorative band 14 is wrapped about the ball shaped ornament 12, said two strips 24 and 26 can overlap and mate together.

Figure 4:
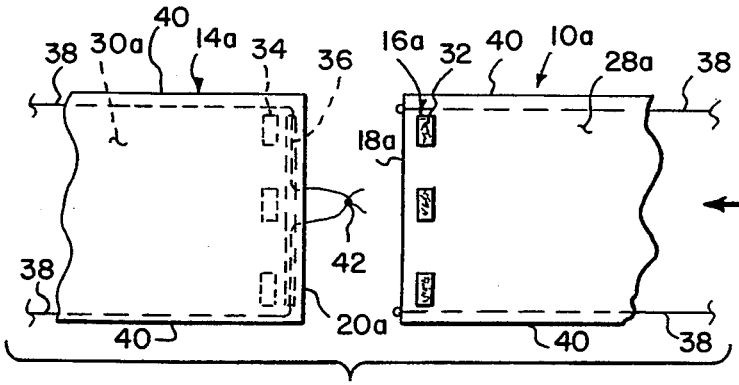
FIG. 4 is an elevational view similar to FIG. 3 in an opened position.
Figure 5:
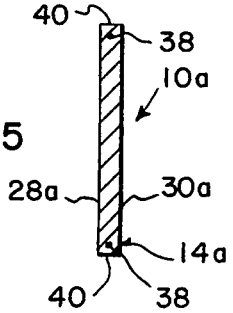
FIG. 5 is a side view taken in the direction of arrow 5 in FIG. 4, showing the pull string within the decorative band.

FIGS. 3, 4 and show a modified decoration **10*a* for the ball shaped ornament 12. The attaching structure 16*a* contains two sets of pads 32 and 34 of mating hook and loop pile fastener material. The first set of pads 32 are affixed in a spaced apart relationship to a first surface 28*a* of the decorative band 14*a*, along the first end 18*a* thereof. The second set of pads 34, are affixed in a spaced apart relationship to a second surface 30*a* of said decorative band 14*a*, along the second end 20*a* thereof. When the decorative band 14*a* is wrapped about the ball shaped ornament 12, said two sets of pads 32 and 34 can overlap and mate together. A stiffener 36 is mounted within the second end 20*a* of the decorative band 14*a***.

A pair of pull strings 38 are provided, with each extending within an opposite long edge 40 of the decorative band **14*a*, with one end of each pull string 38 secured to the first end 18*a* of the decorative band 14*a*. An opposite end of each pull string 38 extends through one portion of the stiffener 36 and out of the second end 20*a* of the decorative band 14*a* to be tied together in a knot 42, so as to be utilized in drawing the edges 40 of the decorative band 14*a* about the ball shaped ornament 12**.

OPERATION OF THE INVENTION

Figure 2A:
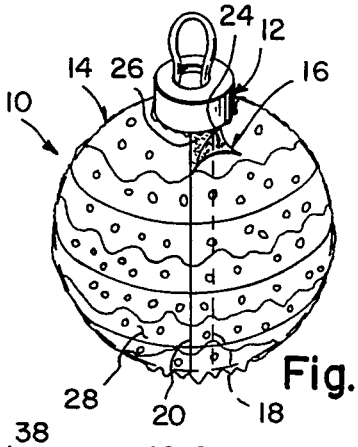
FIG. 2A is another modification in which the decorative band is wide enough to be placed over all of the outer surface of the ball shaped ornament to completely change its appearance.

To use the decoration 10 a person simply wraps the decorative band 14 about the ball shaped ornament 12. The two strips 24 and 26 of the mating hook and loop pile fastener material will overlap and mate together to hold the decorative band 14 thereto. To use the decoration **10*a*, the person will wrap the decorative band 14*a* about the ball shaped ornament 12. The two sets of pads 32 and 34 of the mating hook and loop pile fastener material will also overlap and mate together, to hold the decorative band 14 thereto. The pull strings 38 can be pulled to draw the edges 40 against the ball shaped ornament 12. The decorative band 14 can be narrow as shown in FIG. 2, or wider as shown in FIG. 2A to cover all of the outer surface of the ball shaped ornament 12**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A decoration adapted for mounting about the surface of a ball shaped ornament which comprises:

a) a decorative band made of a pliable material, having spaced elongated edges and transverse opposite ends adapted to wrap around said ornament;

b) means for attaching said ends of said decorative band together over the surface of said ornament so as to change the appearance of said ornament;

c) in combination with adjustable means provided in said band along said edges for gathering said edges in tight engagement with said surface; wherein said adjustable means includes an external end for pulling and tieing together said ends to tighten the band; and d) a stiffener mounted within one of said transverse ends; wherein said attaching means includes strips of mating hook and loop pile fastener material, in which said strips are affixed to opposite surfaces of said decorative band at the two ends so that when said decorative band is wrapped about said ornament said two strips can overlap and mate together.

2. A decoration for said ball shaped ornament as recited in claim 1, wherein said gathering means comprises a pair of pull strings, each extending within said opposite edges of said decorative band with one end of each said pull strings secured to one of said ends of said decorative band, while an opposite end of each said pull string extends through said stiffener and out of the second end of said decorative band to be tied together in a knot so as to be utilized for gathering the edges of said decorative band tightly about said ornament.

* * * * *